US010937436B2

(12) United States Patent
Welvaadt

(10) Patent No.: US 10,937,436 B2
(45) Date of Patent: Mar. 2, 2021

(54) METHOD AND SYSTEM FOR ENCODING AND DECODING OF AUDIO SIGNALS

(71) Applicant: Jochem Welvaadt, Amsterdam (NL)

(72) Inventor: Jochem Welvaadt, Amsterdam (NL)

( * ) Notice: Subject to any disclaimer, the term of this patent is extended or adjusted under 35 U.S.C. 154(b) by 113 days.

(21) Appl. No.: 16/367,919

(22) Filed: Mar. 28, 2019

(65) Prior Publication Data

US 2019/0304478 A1 Oct. 3, 2019

Related U.S. Application Data

(60) Provisional application No. 62/651,104, filed on Mar. 31, 2018.

(51) Int. Cl.
*G10L 19/002* (2013.01)
*G10L 19/16* (2013.01)

(52) U.S. Cl.
CPC ..... *G10L 19/167* (2013.01); *G10L 19/002* (2013.01)

(58) Field of Classification Search
None
See application file for complete search history.

(56) References Cited

U.S. PATENT DOCUMENTS

2016/0378427 A1* 12/2016 Sharma ..... G06F 3/165 700/94

2020/0304144 A1* 9/2020 Milot ..... G06F 17/15

* cited by examiner

*Primary Examiner* — Abul K Azad
(74) *Attorney, Agent, or Firm* — Thomas|Horstemeyer, LLP

(57) ABSTRACT

Method of processing a digital audio input signal containing a sequence of input signal sample values, the method comprising:

determining signal difference values between consecutive pairs of input signal sample values in the sequence of input signal sample values;

determining a normalization value;

dividing each signal difference value in the group of signal difference values by a divider associated with the normalization value;

reducing a bit depth of the normalization value;

reducing a bit depth of each normalized signal difference value in the group of normalized signal difference values;

transmitting the group of reduced normalized signal difference values, and the reduced normalization value;

receiving the transmitted group of reduced normalized signal difference values, and the transmitted reduced normalization value;

multiplying each reduced normalized signal difference value by a multiplier associated with the reduced normalization value;

determining a digital audio output signal containing a sequence of output signal sample values.

18 Claims, 4 Drawing Sheets

METHOD AND SYSTEM FOR ENCODING AND DECODING OF AUDIO SIGNALS

CROSS-REFERENCE TO RELATED APPLICATION

This patent application claims the benefit of priority, under 35 U.S.C. Section 119(e), to U.S. Provisional Patent Application Ser. No. 62/651,104 entitled "Digital wireless audio transmission protocol having low latency and high reliability", filed on Mar. 31, 2018, which is incorporated by reference herein in its entirety.

FIELD OF THE INVENTION

The present invention relates to methods and systems of processing and transmitting a digital audio input signal.

BACKGROUND OF THE INVENTION

Analog wireless audio systems have been around for many years. But now there is an increasing demand for digital wireless audio systems, since they may provide a better sound quality, and since the availability of frequencies or frequency bandwidths, on which analog audio may be transmitted, is reduced.

Nevertheless, digital audio systems are still expected to share frequency bands with other systems. Therefore, a digital wireless audio system should not only coexist with other digital audio systems, but also with bluetooth systems, WiFi, and unwanted radiators such as microwave ovens, etc. A consequence is that an error-free transmission becomes unlikely and that a digital wireless audio system should be able to compensate possible transmission errors, while preserving the audio quality.

A number of solutions to compensate for possible transmission errors exist. A first example is a transmit-acknowledge-retry method, wherein a transmitter will resend data if the receiver does not acknowledge the receipt. A second example is the use of forward error correction wherein additional information is transmitted in order to determine at the receiver whether any data is missing or corrupted. A third example is the use of multiple simultaneous datastreams, wherein data is sent twice or more on different transmission channels, such that a loss of data on one channel does not lead to a loss of the signal information.

However, all these methods have some drawbacks, including e.g. an increase of the transmission delay or an increase of power consumption.

Additionally, a digital audio signal is generally processed before the signal is transmitted. For example, some form of data compression may be applied to enable a faster transmission using a reduced bandwidth. In known frequency domain compression methods, such as those defined by the MPEG, large buffers are required to avoid distortion which would otherwise be caused by the window effect for an applied FFT (Fast Fourier Transformation) conversion. However, the large buffers result in further delays for the transmission. If, for example, such methods were to be used in live music transmission, their performance would be unacceptable, in particular if additional error-correction is performed. Moreover, a processor load for performing FFT operation is high since such operation requires complex mathematical operations. Furthermore, in known PCM (Pulse Code Modulation) systems, transmission errors may result in loss of data leading to discontinuities in the audio output signal.

Recently, a method for processing audio signal has been proposed, wherein no frequency domain compression is needed, permitting a transmission of audio signals with a very low latency.

For example, Dutch Patent No. 2002038 discloses a method and a system for processing a digital input signal containing a sequence of input signal sample values. In the method, signal difference values between pairs of subsequent input signal sample values, and a divider for a group of subsequent signal difference values are determined. The subsequent signal difference values are coded by dividing each signal difference value of the group of subsequent signal difference values by the divider to obtain a group of coded signal difference values. The group of coded signal difference values, and the divider are transmitted through a transmission path. After receipt, the coded signal difference values are decoded by multiplying each coded signal difference value of the group of coded signal difference values by the corresponding divider to obtain a group of decoded signal difference values. A digital output signal containing subsequent output sample values from the decoded signal difference values by adding a decoded signal difference value to a sum of previous decoded signal difference value is determined.

However, the method and the system disclosed in said reference may require a higher bit rate than the bit rate which is available, and may insufficiently correct for noise that may be caused during the processing and/or transmission of the audio signal.

SUMMARY OF THE INVENTION

It would be desirable to provide methods and systems of transmission of digital audio signals having a low transmission delay and having low bit rate requirements. It would also be desirable to provide methods and systems of transmission of digital audio signals in which an original analog audio signal remains substantially undistorted despite the occurrence of data losses and noise signals, without requiring a higher bit rate, and without substantially increasing a latency.

To better address one or more of these concerns, in a first aspect of the invention a method of processing a digital audio input signal containing a sequence of input signal sample values is provided, the method comprising:

determining signal difference values between consecutive pairs of input signal sample values in the sequence of input signal sample values, to obtain a group of signal difference values comprising consecutive signal difference values;

determining a normalization value for the group of signal difference values;

dividing each signal difference value in the group of signal difference values by a divider associated with the normalization value, to obtain a group of normalized signal difference values;

reducing a bit depth of the normalization value to obtain a reduced normalization value;

reducing a bit depth of each normalized signal difference value in the group of normalized signal difference values to obtain a group of reduced normalized signal difference values;

transmitting the group of reduced normalized signal difference values, and the reduced normalization value;

receiving the transmitted group of reduced normalized signal difference values, and the transmitted reduced normalization value;

multiplying each reduced normalized signal difference value by a multiplier associated with the reduced normalization value, to obtain a group of denormalized signal difference values; and determining a digital audio output signal containing a sequence of output signal sample values, wherein each output signal sample value is obtained by adding a corresponding denormalized signal difference value to an immediately preceding output signal sample value.

In an embodiment, the step of determining the digital audio output signal further comprises the steps of:

determining a group of correction values, wherein the group of correction values comprises the same number of values as the number of values in the group of denormalized signal difference values, and wherein each correction value is obtained by adding a denormalized signal difference value to a corresponding previous correction value; and subtracting each correction value from a corresponding output signal sample value.

In an embodiment, each correction value has a higher bit depth than the bit depth of a denormalized signal difference value.

In an embodiment, determining a normalization value comprises:

determining a largest signal difference value in the group of signal difference values; and determining the normalization value based on the largest signal difference value.

In an embodiment, the step of determining the normalization value based on the largest signal difference value comprises:

setting the normalization value equal to the largest signal difference value.

In an embodiment, the step of determining the normalization value based on the largest signal difference value comprises:

setting the normalization value equal to the position of the first nonzero bit closest to the most significant bit of the largest signal difference value.

In an embodiment, the step of determining the normalization value based on the largest signal difference value comprises:

setting the normalization value equal to a value obtained after performing a first mathematical operation on the largest signal difference value.

In an embodiment, the step of determining the normalization value based on the largest signal difference value comprises:

setting the normalization value equal to a position in a first lookup table associated with the largest signal difference value.

In an embodiment, the step of determining the normalization value based on the largest signal difference value or the first mathematical operation on the largest signal difference value comprises:

selecting a digital precision expressed as a number of bits;

determining a factor being at most equal to the largest number expressible in said number of bits;

dividing the largest signal difference value by the factor to obtain a quotient;

setting the normalization value to a value obtained after performing a second mathematical operation on the quotient.

In an embodiment, the divider is set equal to the normalization value; and the multiplier is set equal to the reduced normalization value.

In an embodiment, the divider is obtained by performing a third mathematical operation on the normalization value; and the multiplier is obtained by performing a fourth mathematical operation on the reduced normalization value.

In an embodiment, the divider is set equal to a first lookup value in the first lookup table, wherein a position of the first lookup value in the first lookup table is associated with the normalization value; and the multiplier is set equal to a second lookup value in a second lookup table, wherein a position of the second lookup value in the second lookup table is associated with the reduced normalization value.

In an embodiment, dividing each signal difference value comprises performing a first arithmetic shift of each signal difference value, moving every bit of the respective signal difference value a number of positions, wherein the number is associated with the normalization value, in the direction of the least significant bit of the respective signal difference value, and wherein multiplying each reduced normalized signal difference value comprises performing a second arithmetic shift of each reduced normalized signal difference value, moving every bit of the respective reduced normalized signal difference value a number of positions, wherein the number is associated with the reduced normalization value, in the direction of the most significant bit of the respective reduced normalized signal difference value.

In an embodiment, reducing a bit depth comprises truncating a number of bits.

In an embodiment, at least some of the groups of reduced normalized signal difference values and the corresponding reduced normalization values are transmitted at different frequencies.

In an embodiment, the sequence of input signal sample values contains a part of a sequence of input signal values of a previously processed digital audio input signal.

In a second aspect of the invention, a method of coding a digital audio input signal containing a sequence of input signal sample values is provided, the coding method comprising:

determining signal difference values between consecutive pairs of input signal sample values in the sequence of input signal sample values, to obtain a group of signal difference values comprising consecutive signal difference values;

determining a normalization value for the group of signal difference values;

dividing each signal difference value in the group of signal difference values by a divider associated with the normalization value, to obtain a group of normalized signal difference values;

reducing a bit depth of the normalization value to obtain a reduced normalization value;

reducing a bit depth of each normalized signal difference value in the group of normalized signal difference values to obtain a group of reduced normalized signal difference values; and transmitting the group of reduced normalized signal difference values, and the reduced normalization value.

In a third aspect of the invention, a method of decoding a digital audio input signal containing a sequence of input signal sample values coded according to the invention to obtain the group of reduced normalized signal difference values, and the reduced normalization value is provided, the decoding method comprising:

receiving the transmitted group of reduced normalized signal difference values, and the transmitted reduced normalization value;

multiplying each reduced normalized signal difference value by a multiplier associated with the reduced normalization value, to obtain a group of denormalized signal difference values; and determining a digital audio output signal containing a sequence of output signal sample values, wherein each output signal sample value is obtained by adding a corresponding denormalized signal difference value to an immediately preceding output signal sample value.

In a fourth aspect of the invention, a system for processing a digital audio input signal containing a sequence of input signal sample values is provided, the system comprising:

a first processor configured to determine signal difference values between consecutive pairs of input signal sample values in the sequence of input signal sample values, to obtain a group of signal difference values comprising consecutive signal difference values;

determine a normalization value for the group of signal difference values;

divide each signal difference value in the group of signal difference values by a divider associated with the normalization value, to obtain a group of normalized signal difference values;

reduce a bit depth of the normalization value to obtain a reduced normalization value; and reduce a bit depth of each normalized signal difference value in the group of normalized signal difference values to obtain a group of reduced normalized signal difference values;

a transmitter coupled to the first processor, the transmitter being configured to transmit the group of reduced normalized signal difference values, and the reduced normalization value;

a receiver configured to receive the transmitted group of reduced normalized signal difference values, and the transmitted reduced normalization value; and a second processor coupled to the receiver, the second processor being configured to multiply each reduced normalized signal difference value by a multiplier associated with the reduced normalization value, to obtain a group of denormalized signal difference values; and determine a digital audio output signal containing a sequence of output signal sample values, wherein each output signal sample value is obtained by adding a corresponding denormalized signal difference value to an immediately preceding output signal sample value.

In a fifth aspect of the invention, system for coding a digital audio input signal containing a sequence of input signal sample values is provided, the system comprising:

a first processor configured to determine signal difference values between consecutive pairs of input signal sample values in the sequence of input signal sample values, to obtain a group of signal difference values comprising consecutive signal difference values;

determine a normalization value for the group of signal difference values;

divide each signal difference value in the group of signal difference values by a divider associated with the normalization value, to obtain a group of normalized signal difference values;

reduce a bit depth of the normalization value to obtain a reduced normalization value; and reduce a bit depth of each normalized signal difference value in the group of normalized signal difference values to obtain a group of reduced normalized signal difference values;

a transmitter coupled to the first processor, the transmitter being configured to transmit the group of reduced normalized signal difference values, and the reduced normalization value.

In a sixth aspect of the invention, a system for decoding a digital audio input signal containing a sequence of input signal sample values coded by the coding system according to the invention is provided, the decoding system comprising:

a receiver configured to receive the transmitted group of reduced normalized signal difference values, and the transmitted reduced normalization value; and a second processor coupled to the receiver, the second processor being configured to multiply each reduced normalized signal difference value by a multiplier associated with the reduced normalization value, to obtain a group of denormalized signal difference values; and determine a digital audio output signal containing a sequence of output signal sample values, wherein each output signal sample value is obtained by adding a corresponding denormalized signal difference value to an immediately preceding output signal sample value.

In a seventh aspect of the invention, a first non-transitory computer readable medium storing a computer program causing a computer to execute a coding method of coding a digital audio input signal containing a sequence of input signal sample values is provided, the coding method comprising:

determining signal difference values between consecutive pairs of input signal sample values in the sequence of input signal sample values, to obtain a group of signal difference values comprising consecutive signal difference values;

determining a normalization value for the group of signal difference values;

dividing each signal difference value in the group of signal difference values by a divider associated with the normalization value, to obtain a group of normalized signal difference values;

reducing a bit depth of the normalization value to obtain a reduced normalization value;

reducing a bit depth of each normalized signal difference value in the group of normalized signal difference values to obtain a group of reduced normalized signal difference values; and initiating a transmitting of the group of reduced normalized signal difference values, and the reduced normalization value.

In an eight aspect of the invention, a second non-transitory computer readable medium storing a computer program causing a computer to execute a decoding method of decoding a digital audio input signal containing a sequence of input signal sample values coded according to the coding method of the invention is provided, the decoding method comprising:

initiating a receiving of the transmitted group of reduced normalized signal difference values, and the transmitted reduced normalization value;

multiplying each reduced normalized signal difference value by a multiplier associated with the reduced normalization value, to obtain a group of denormalized signal difference values; and determining a digital audio output signal containing a sequence of output signal sample values, wherein each output signal sample value is obtained by adding a corresponding denormalized signal difference value to an immediately preceding output signal sample value.

The present methods and systems for transmission of digital audio signals provide several advantages, such as:

- possibility to transmit 'spread spectrum' with a single transmitter, such that it is possible to cope with stationary interference.
- possibility to achieve very low latency, due to the use of small buffers and simple calculations.
- possibility to effectively suppress noise, by preservation of phase information of the audio signal.
- possibility of low power usage and better co-existence with other radio systems, due to a low transmitter duty cycle.

The present methods and systems achieve a very low latency partly due to reducing the bit size of the normalization value and of each normalized signal difference value. This reduction may be achieved by the present invention using very simple methods such as truncating a bit representation of a number. Generally, compression methods may lead to losing information on the digital audio input signal. This loss of information may lead to distortions in the audio signal that may be unpleasant to a listener, which is especially the case when using frequency domain compression. The present invention relies on time-domain compression, which has several advantages. For example, despite losing information on digital audio input signal, the quality of the digital audio output signal may be not be deteriorated substantially and its subjective 'pleasantness' to listen to may be high, which is an advantage of the present invention. This may also be caused and/or improved by using the determined correction values.

These and other aspects of the invention will be more readily appreciated as the same becomes better understood by reference to the following detailed description and considered in connection with the accompanying drawings in which like reference symbols designate like parts.

BRIEF DESCRIPTIONS OF THE DRAWINGS

DETAILED DESCRIPTION OF EMBODIMENTS

Figure 1:
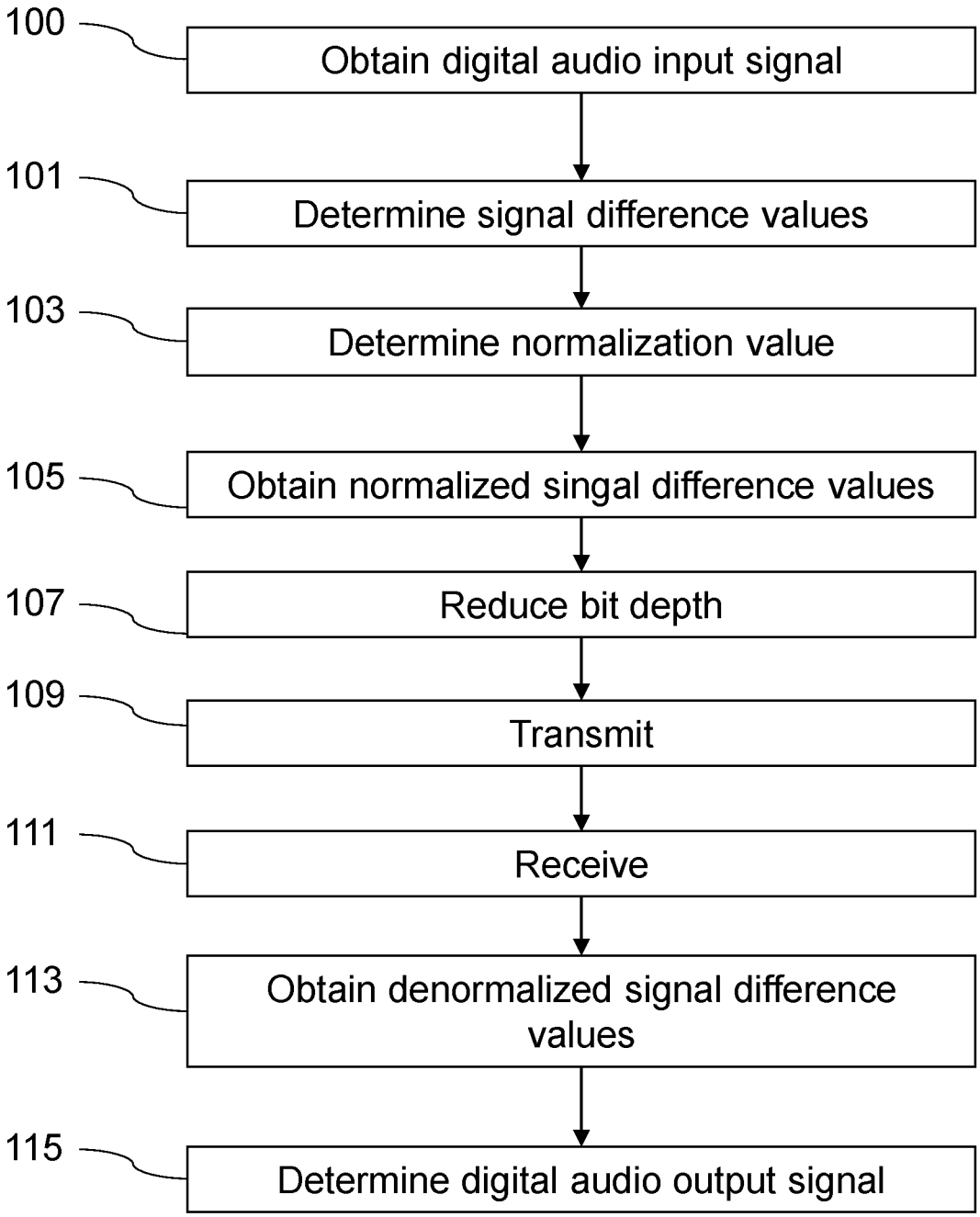
FIG. 1 depicts a first flow diagram of an embodiment of a method of processing a digital audio input signal.

In FIG. 1, a first flow diagram of an embodiment of a method of processing a digital audio input signal is depicted, wherein the digital audio input signal contains a sequence of input signal sample values In step 100, a digital audio input signal is obtained.

The digital audio input signal may be obtained from another (digital) device, such as a computer, a memory device, an analog-digital converter, ADC, an instrument, etc. which generates a digital signal that may serve as the digital audio input signal. The digital audio input signal may be associated with a predetermined sampling rate (e.g. 44.1 kHz, 48 kHz or 96 kHz) and may have a predetermined precision or bit depth (e.g. 8 bit, 12 bit, 16 bit, 24 bit or 32 bit). Alternatively, an analog audio input signal AS is supplied to an analog-to-digital converter ADC which converts the analog audio input signal into a digital audio input signal DS at a predetermined sampling rate (e.g. 44.1 kHz, 48 kHz or 96 kHz) and with a predetermined precision (e.g. 8 bit, 12 bit, 16 bit, 24 bit or 32 bit). Various sampling rates and precisions are possible within the scope of the present invention. We assume for the sake of illustration that the digital audio input signal comprises input signal sample values with a precision or bit depth of 32 bit.

To further illustrate step 100 and following steps, Table 1 is provided below, wherein, in the first column, sample numbers are provided and, in the second column, digital audio input signal values associated with the sample numbers are provided. In the present exemplary embodiment, a sequence of input signal sample values is associated with sample numbers 6, 7, 8, 9, and 10. This sequence of input signal sample values is indicated in Table 1 with a bold font. During a normal operation of the method, at least a part of the sequence of previous digital audio input signals has been processed earlier.

TABLE 1

| Sample no. | Digital audio input signal sample value | Signal difference value | Divider | Normalized signal difference value | Denormalized signal difference value |
|---|---|---|---|---|---|
| 1 | 15.653.827 | — | 11.275 | 0 | |
| 2 | 17.085.739 | 1.431.912 | 11.275 | 127 | 1.431.925 |
| 3 | 18.357.826 | 1.272.097 | 11.275 | 113 | 1.274.075 |
| 4 | 19.613.283 | 1.255.447 | 11.275 | 111 | 1.251.525 |
| 5 | 20.364.106 | 750.823 | 11.275 | 67 | 755.425 |
| 6 | 20.628.369 | 264.263 | 3847 | 69 | 265.443 |
| 7 | 20.526.853 | −101.516 | 3847 | −26 | −100.022 |
| 8 | 20.948.326 | 421.473 | 3847 | 110 | 423.170 |
| 9 | 21.436.927 | 488.601 | 3847 | 127 | 488.569 |
| 10 | 21.893.682 | 456.755 | 3847 | 119 | 457.793 |
| 11 | 21.705.326 | −188.356 | 15.300 | −12 | −183.600 |
| 12 | . . . | . . . | . . . | . . . | . . . |

In step 101, signal difference values between consecutive pairs of input signal sample values in the sequence of input signal sample values are determined, to obtain a group of signal difference values comprising consecutive signal difference values.

In the third column of Table 1, signal difference values are provided. E.g., the signal difference value associated with sample number 9 is obtained by subtracting 20.948.326 (sample number 8) from 21.436.927 (sample number 9).

In step 103, a normalization value for the group of signal difference values is determined.

To determine the normalization value, the largest signal difference value in the group of signal difference values may be determined. In this case (sample numbers 6, 7, 8, 9 and 10) the largest signal difference value is 488.601, associated with sample number 9. The largest signal difference value may refer to the largest absolute value of the signal difference value in the group of signal difference values, i.e. −500.000 may be regarded as larger than 488.601.

As a first example, the normalization value may be set equal to the largest signal difference value. In this case the normalization value is 488.601. The 32 bit representation of 488.601 may be '00000000 00000111 01110100 10011001'.

Various alternative representations may exist, depending on the endianness of which the big-endian and little-endian formats are well known.

As a second example, the normalization value may be set equal to the position of the first nonzero bit closest to the most significant bit of the largest signal difference value. The 32 bit representation of 488.601 may be '00000000 00000111 01110100 10011001'. In this case the position of the first nonzero bit closest to the most significant bit is 19, which may have a 32 bit representation of '00000000 00000000 00000000 00010011'.

As a third example, the normalization value may be set equal to a value obtained after performing a first mathematical operation on the largest signal difference value. For example, the first mathematical operation may comprise selecting a digital precision, expressed as a number of bits. For illustration purposes an 8 bit precision may be selected. From the selected precision, a factor is determined, which is the largest (or at most the largest) number to be expressed in said number of bits in a specific notation. In the example, the factor is selected to be the largest 8 bit number in two's complement notation, i.e. 127. Now, the normalization value is obtained by dividing the largest signal difference value by the factor to obtain a quotient: 488.601/127=3847. In this example, a second mathematical operation is applied to the quotient which results in a value which is identical to the quotient.

In step 105, each signal difference value in the group of signal difference values is divided by a divider associated with the normalization value, to obtain a group of normalized signal difference values.

The divider may be set equal to the normalization value. In this case, one may regard steps 103 and 105 as a single step, wherein the divider is obtained based e.g. the largest signal difference value. Alternatively, the divider may be obtained by performing a third mathematical operation on the normalization value.

Next, all signal difference values of the group of signal difference values are divided by the same divider. In this case the divider is set equal to the normalization value 3847, which results in the numbers in the fifth column in Table 1 (normalized signal difference values). The normalized signal difference values are rounded to the nearest integer.

In step 107, a bit depth of the normalization value may be reduced to obtain a reduced normalization value.

Also, a bit depth of each normalized signal difference value in the group of normalized signal difference values may be reduced to obtain a group of reduced normalized signal difference values.

Figure 3:
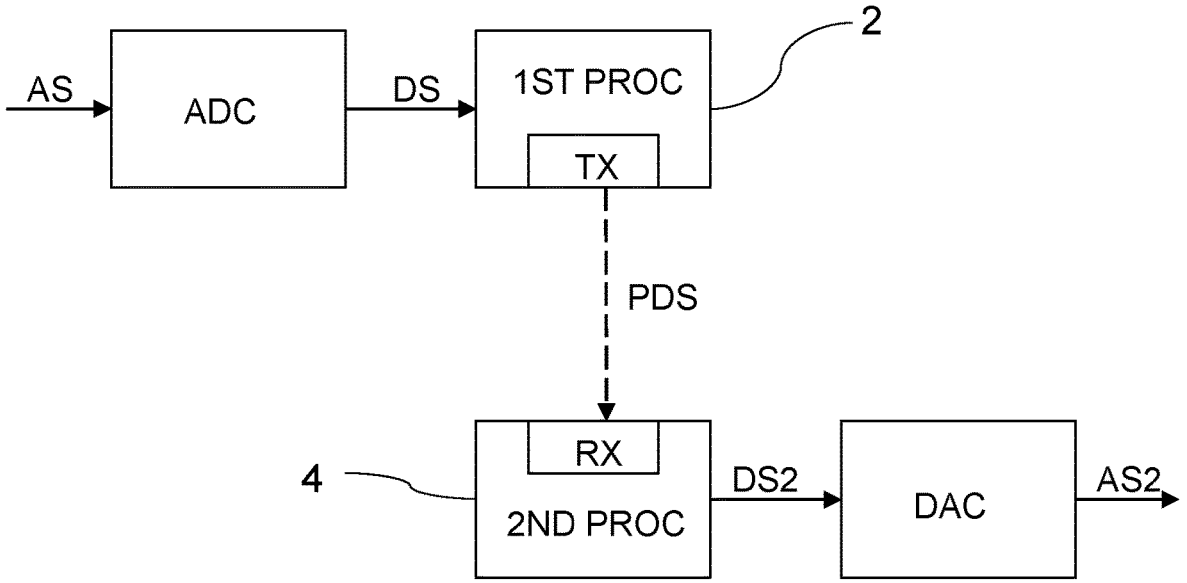
FIG. 3 depicts an embodiment of a system for processing a digital audio input signal.

From the description of steps 103 and 105, it may follow that a bit representation of the normalization value and of each normalized signal difference value in the group of normalized signal difference values may start with a plurality of zeros. Therefore, it is possible to reduce the bit depth of those values without losing information. An exemplary method to reduce the bit depth is to truncate a plurality of zeros that do not provide additional information. For example, the 32 bit representation of 488.601 may be '00000000 00000111 01110100 10011001', which may be truncated to a 24 bit representation by dropping the first eight zeros on the left, yielding '00000111 01110100 10011001'. The representation '00000111 01110100 10011001' may be truncated to a 16 bit representation by additionally dropping 8 bits to the right, yielding '00000111 01110100'. Information on the amount of bits dropped on the left and/or information on the amount of bits dropped on the right may be available at the second processor 4. This information may be predetermined or may be transmitted by the transmitter TX (FIG. 3) and received by the receiver RX (FIG. 3). To preserve more information on the original value, the representation '00000000 00000111 01110100 10011001', may be truncated from the left and the right to obtain a 16 bit presentation '111 01110100 10011'. Note the three most right bits have been dropped. Loosing information on the bit values on the right may represent a rounding of the respective number, since '111 01110100 100.11' may be reconstructed into '111 01110100 10011000'.

The representation may be a signed representation, wherein a sign bit represents whether the number is positive or negative. This sign bit may be transmitted. In this example, the most significant bit may be the bit most left, which may indicate the sign of the represented number. In this example, a 16 bit representation of '0 111 01110100 1001' may be obtained, wherein the most significant bit is preserved. Various possibilities exist to reduce the bit size that may involve truncating bits from the left or the right. It may be beneficial to truncate bits on the side of the most significant bit, the bits that may not contain additional information, such as the first zeros (commonly associated with a positive number) or the first ones (commonly associated with a negative number) following the most significant bit, which may be 0 or 1, commonly associated with a positive or negative number, respectively. It may be beneficial to truncate bits on the side of the least significant bit, while predetermining or transmitting information on the amount of truncated bits on the side of the least significant bit, to obtain a rounding of the number.

Thus, herein 'truncating' a value may involve rounding the value.

The bit depth of the normalization value may be reduced by a different number of bits than the normalized signal difference values. For example, the 32 bit representation of 3847, the normalization value, may be '00000000 00000000 00001111 00000111' which may be truncated to a 12 bit representation by dropping the first twenty zeros on the left, yielding '1111 00000111'. Typically, a left truncation is performed since the most significant bit is typically on the left. Also a right truncation may be useful if losing the information associated with the least significant bits is acceptable. Generally, the preferred truncation depends on the bit representation of a number. Also, a combination of a left truncation and a right truncation may be performed. Reducing bit depth of the normalization value may be performed similar to the reducing of the normalized signal difference values.

In step 109, the group of reduced normalized signal difference values, and the reduced normalization value are transmitted.

In step 111, the transmitted group of reduced normalized signal difference values, and the reduced normalization value are received.

As illustrated in FIG. 3, transmitting and receiving of the reduced normalized signal difference values, and the reduced normalization value may be achieved by various types of transmitters TX and receivers RX, respectively. The transmission may be wireless or wired. The transmitter TX may be part of a first processor 2 or may be a separate unit connected to the first processor 2. Similarly, the receiver RX be part of a second processor 4 or may be a separate unit connected to the second processor 4. Different communication or transmission protocols may be used within the scope of the present invention. The protocols may include mechanisms for addressing, sub-addressing, encryption, error detection etc. To improve or to enable improving a resiliency to data losses, at least some of the groups of reduced normalized signal difference values and the corresponding reduced normalization values may be transmitted at different frequencies f1, f2. The first and second processors 2, 4 may comprise, or be coupled to, one or more memories storing processing software and/or other data to be used in the processing performed by the first and second processors 2, 4, such as in the form of look-up tables.

In step 113, each reduced normalized signal difference value is multiplied by a multiplier associated with the reduced normalization value, to obtain a group of denormalized signal difference values.

The multiplier may be set equal to the reduced normalization value. Alternatively, the multiplier may be obtained by performing a fourth mathematical operation on the reduced normalization value. The fourth mathematical operation may be the inverse operation of the third mathematical operation. The fourth mathematical operation may comprise steps to add new bits to the bit representation of the reduced normalized signal difference value, or reduced normalization value that have been reduced in bit size or have been truncated in step 107. For example, if three bits have been truncated on the side of the least significant bit in step 107, three bits, possibly zeros or ones may be added, shifting the bits of the reduced normalized signal difference value to the side of the most significant bit.

The reduced normalized signal difference values are multiplied by the corresponding multiplier to obtain denormalized signal difference values, as illustrated in the sixth column of Table 1. Due to rounding errors, the denormalized signal difference values may deviate slightly from the (original) signal difference values. Thus, a slight loss of data may occur which, however, is quite acceptable in audio applications. Multiplying may also comprise a step to shift bits in the bit representation to compensate or undo partly the truncation in step 107. Table 1 provides numerical values. Operations on the numerical values may be performed by performing suitable operations on the bit representation of the respective numerical value.

In step 115, a digital audio output signal containing a sequence of output signal sample values is determined, wherein each output signal sample value is obtained by adding a corresponding denormalized signal difference value to an immediately preceding output signal sample value. For example the initial output signal sample value may be zero. Table 2 illustrates the obtained digital output audio signal sample values.

TABLE 2

| Sample no. | Digital audio input signal sample value | Denormalized signal difference value | Digital audio output signal sample value |
|---|---|---|---|
| 1 | 15.653.827 | | 0 |
| 2 | 17.085.739 | 1.431.925 | 1.431.925 |
| 3 | 18.357.826 | 1.274.075 | 2.706.000 |
| 4 | 19.613.283 | 1.251.525 | 3.957.525 |
| 5 | 20.364.106 | 755.425 | 4.712.950 |
| 6 | 20.628.369 | 265.443 | 4.978.393 |
| 7 | 20.526.853 | −100.022 | 4.878.371 |
| 8 | 20.948.326 | 423.170 | 5.301.541 |
| 9 | 21.436.927 | 488.569 | 5.790.110 |
| 10 | 21.893.682 | 457.793 | 6.247.903 |
| 11 | 21.705.326 | −183.600 | 6.064.303 |
| 12 | . . . | . . . | . . . |

Each digital output signal sample value depends on the initial digital output signal sample value (here chosen to be zero). This initial value may be regarded as a constant offset. Information on the absolute value of the digital input signal sample may be lost and only the relative information is transmitted. However, this does not deteriorate the obtained audio signal, since it is common practice to filter out or adjust any constant offset anyhow.

Steps 100-115, or part thereof, may be executed by a computer, wherein a non-transitory computer readable medium storing a program causes the computer to execute (part of) steps 100-115. Steps 109 and 111 may be initiated in the respective program by the computer.

In step 103 a different normalization values may be obtained, such that the outcomes of the remaining steps may change. Here, an example is provided wherein the normalization value is set to a value obtained by performing a second mathematical operation on a quotient. The normalization value is obtained by performing a $^{2}$ log(quotient) function, while again using a quotient in line with an 8 bit precision. Table 1 b below provides values associated with this example. The digital audio input signal values are identical to the ones provided in Table 1. In this example, the factor is selected to be a large 8 bit number, i.e. 119, different from 127 which was chosen before. The quotient is again obtained by dividing the largest signal difference value by the factor: 488.601/119=4096. The normalized signal difference values are obtained by dividing the respective signal difference values by 4096. In this example, the normalization value is not set to 4096, but to $^{2}$ log(quotient), yielding $^{2}$ log (4096)=12, which will be transmitted. Note that the divider is equal to a value obtained by performing a third mathematical operation on the normalization value, namely a $2^{(normalization\ value)}$ function, yielding in this example a divider of $2^{12}$=4096.

TABLE 1b

| Sample no. | Digital audio input signal sample value | Signal difference value | $^{2}$log(quotient)/quotient | Normalized signal difference value | Denormalized signal difference value |
|---|---|---|---|---|---|
| 1 | 15.653.827 | — | 14/16.384 | 0 | |
| 2 | 17.085.739 | 1.431.912 | 14/16.384 | 87 | 1.425.408 |
| 3 | 18.357.826 | 1.272.097 | 14/16.384 | 78 | 1.277.952 |
| 4 | 19.613.283 | 1.255.447 | 14/16.384 | 77 | 1.261.568 |
| 5 | 20.364.106 | 750.823 | 14/16.384 | 46 | 753.664 |
| 6 | 20.628.369 | 264.263 | 12/4.096 | 65 | 266.240 |
| 7 | 20.526.853 | −101.516 | 12/4.096 | −25 | −102.400 |
| 8 | 20.948.326 | 421.473 | 12/4.096 | 103 | 421.888 |
| 9 | 21.436.927 | 488.601 | 12/4.096 | 119 | 487.424 |
| 10 | 21.893.682 | 456.755 | 12/4.096 | 112 | 458.752 |
| 11 | 21.705.326 | −188.356 | 14/16.384 | −11 | −180.224 |
| 12 | . . . | . . . | . . . | . . . | . . . |

In step 113, the reduced normalized signal difference values are multiplied by a multiplier. The multiplier may be obtained by performing a fourth mathematical operation. The fourth mathematical operation may invert the third mathematical operation. In this example, the multiplier is obtained by performing a $2^{(reduced\ normalization\ value)}$ function, which results in this example in a multiplier of $2^{12}$=4096. In different embodiments, different normalization values may be obtained by performing a different second mathematical operation. Examples of other mathematical operations are a $^{b}$ log(quotient) function, wherein b is a base of the logarithm, or a sqrt(quotient) function, wherein sqrt indicates that a square root is taken of the quotient.

There may be possibilities to perform some mathematical operations more efficient or faster. In an example, dividing each signal difference value comprises performing a first arithmetic shift of each signal difference value, moving every bit of the respective signal difference value a number of positions, wherein the number is associated with the normalization value, in the direction of the least significant bit of the respective signal difference value, and multiplying each reduced normalized signal difference value comprises performing a second arithmetic shift of each reduced normalized signal difference value, moving every bit of the respective reduced normalized signal difference value a number of positions, wherein the number is associated with the reduced normalization value, in the direction of the most significant bit of the respective reduced normalized signal difference value.

These ways of dividing and multiplying may be called bit-shifting.

To avoid or simplify some calculations a lookup table may be used.

The step of determining the normalization value based on the largest signal difference value may comprise setting the normalization value equal to a position in a first lookup table associated with the largest signal difference value.

An example of a first lookup table is

| Largest signal difference value (range) | Position | Lookup value |
|---|---|---|
| −600.000--400.001 | 1 | 1000 |
| −400.000-0 | 2 | 2000 |
| 1-200.000 | 3 | 3000 |
| 200.001-400.000 | 4 | 4000 |
| 400.001-600.000 | 5 | 5000 |

In this case, the value of 488.601 would may be associated with position 5, which may have a 32 bit representation of '00000000 00000000 00000000 00000101'.

Similarly, the divider may be set equal to a first lookup value in the first lookup table, wherein a position of the first lookup value in the first lookup table is associated with the normalization value. The divider may be set to 5000 corresponding to position 5. Similarly, the multiplier may set equal to a second lookup value in a second lookup table, wherein a position of the second lookup value in the second lookup table is associated with the reduced normalization value.

Various calculations or mathematical operations may be performed by using a lookup table that may comprise an array that replaces runtime computation with a simpler array indexing operation. The savings in terms of processing time may be significant, since retrieving a value from memory is often faster than undergoing an "expensive" computation or input/output operation. The lookup tables may be predetermined and stored in static program storage.

Figure 2:
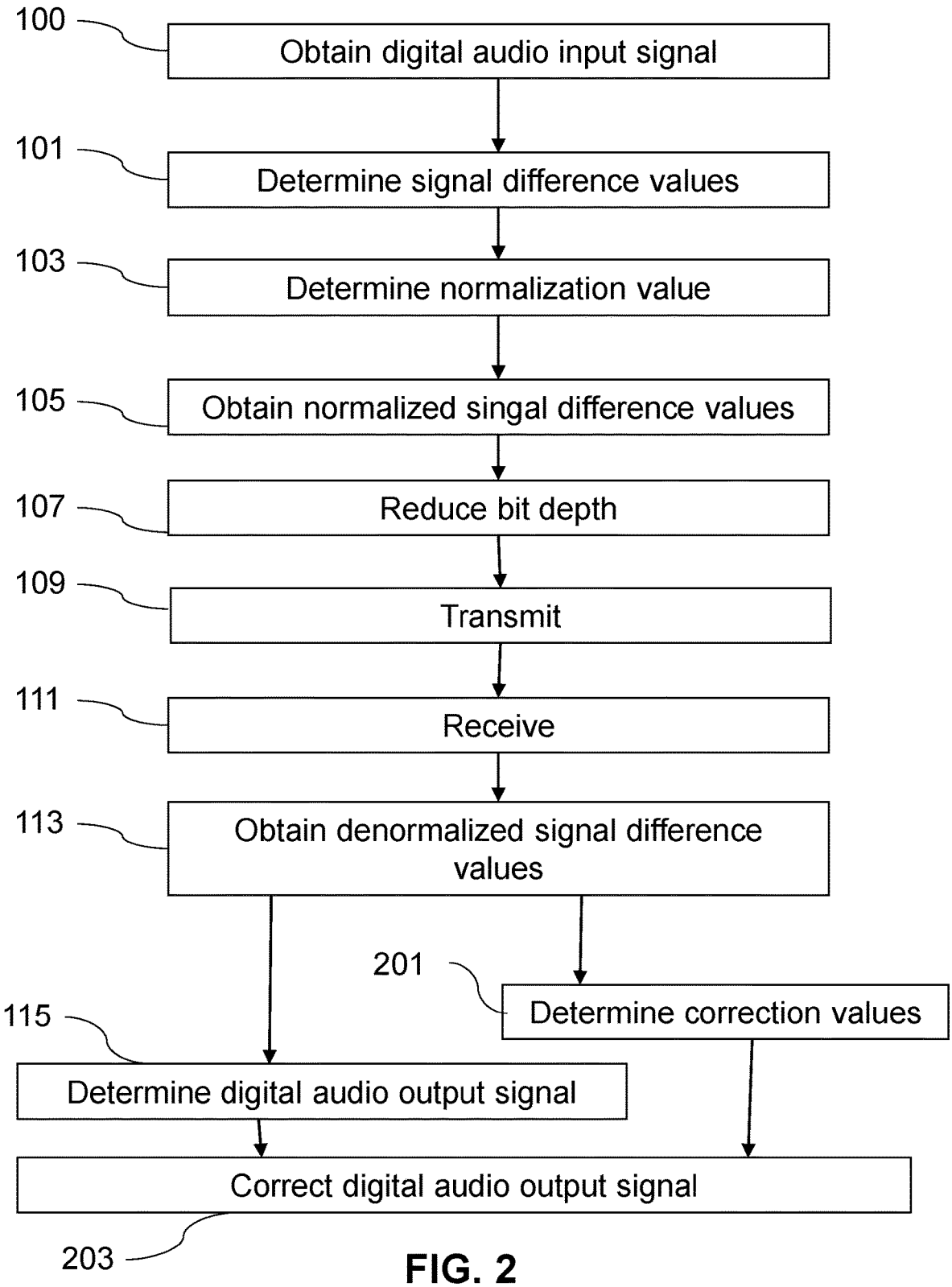
FIG. 2 depicts a second flow diagram of an embodiment of a method of processing a digital audio input signal.

In FIG. 2 a second flow diagram of another embodiment of a method of processing a digital audio input signal is depicted, wherein the digital audio input signal contains a sequence of input signal sample values. The second flow diagram extends the first flow diagram of FIG. 1 with two additional steps, step 201 and step 203, to correct the digital audio output signal which is determined in step 115. Only steps 201 and 203 are discussed below. Reference is made to the description of FIG. 1 for a description of the remaining steps.

In step 201, a group of correction values is determined, wherein the group of correction values comprises the same number of values as the number of values in the group of denormalized signal difference values, and wherein each correction value is obtained by adding a denormalized signal difference value to a corresponding previous correction value.

During processing, transmitting and receiving various noise signals may occur, altering the digital audio output signal or intermediate determined values. However, the noise may be similar every time a similar operation is performed. In the description of FIG. 1, the number of values in the group of denormalized signal difference values is five. To further illustrate the occurrence of noise, it is assumed that during the processing of every third value, some interference causes an increase of the respective denormalized signal difference value. In Table 3 a numerical example is provided, wherein three out of a sequence of N+1 denormalized signal difference values are depicted. In case many denormalized signal difference values have been processed, i.e. N is large, the correction value is expected to be close to zero in the absence of noise, since positive and negative amplitude changes of audio signals will be equal in the long run. However, noise signals that are present each time at the same processing step will be amplified. This is further illustrated in Table 3, wherein the noise is amplified by adding denormalized signal difference values associated with sample numbers 8, 13, 18, etc., leading to a high correction value.

TABLE 3

| Sample no. | Denormalized signal difference value t = 0 | Denormalized signal difference value t = 1 | Denormalized signal difference value t = N | Correction value t = N |
|---|---|---|---|---|
| 6 + t * 5 | 265.443 | 343.411 | 0 | 0.03 |
| 7 + t * 5 | −100.022 | 271.001 | 239.000 | −1 |
| 8 + t * 5 | 423.170 + 1000 | 2.453 + 1000 | −245.878 + 1000 | N * 1000 |
| 9 + t * 5 | 488.569 | −241.942 | 945.234 | 0.3 |
| 10 + t * 5 | 457.793 | 0 | 408.98785 | −0.2 |

If a noise signal is present, a corresponding correction value may become quite large. To prevent an overflow of a correction value, the correction value may have a higher bit depth than the bit depth of a denormalized signal difference value. For example, the bit depth of a correction value may be 48 bit, which may be substantially larger than a needed bit depth of a denormalized signal difference value.

In step 203, each correction value is subtracted from a corresponding output signal sample value.

By subtraction the correction value from a corresponding output signal sample value, the noise in the denormalized signal difference value may be compensated.

In this example, a noise signal is present in every 3+t*5-th sample value, wherein t is an integer. A corrected digital audio output signal sample value may be obtained by subtracting the correction value from the corresponding uncorrected digital audio output signal value. This process is illustrated in Table 4, provided below.

TABLE 4

| Sample no. | Uncorrected digital audio output signal sample value | Correction value | Corrected digital audio output signal sample value |
|---|---|---|---|
| 1 + t − 1 | 0 | 0 | 0 |
| 2 + t − 1 | 1.431.925 | 0 | 1.431.925 |
| 3 + t − 1 | 2.706.000 + (t − 1) * 1000 | (t − 1) * 1000 | 2.706.000 |

TABLE 4-continued

| Sample no. | Uncorrected digital audio output signal sample value | Correction value | Corrected digital audio output signal sample value |
|---|---|---|---|
| 4 + t − 1 | 3.957.525 | 0 | 3.957.525 |
| 5 + t − 1 | 4.712.950 | 0 | 4.712.950 |
| 6 + t | 4.978.393 | 0 | 4.978.393 |
| 7 + t | 4.878.371 | 0 | 4.878.371 |
| 8 + t | 5.301.541 + t * 1000 | t * 1000 | 5.301.541 |
| 9 + t | 5.790.110 | 0 | 5.790.110 |
| 10 + t | 6.247.903 | 0 | 6.247.903 |
| 11 + t + 1 | 6.064.303 | 0 | 6.064.303 |
| 12 + t + 1 | . . . | . . . | . . . |

Steps 201 and 203 may be executed by a computer, wherein a non-transitory computer readable medium storing a program causes the computer to execute steps 201 and 203.

FIG. 3 depicts an audio processing system comprising an analog-to-digital converter ADC, a first processor 2, a second processor 4, and a digital-to-analog converter DAC. The first processor 2 may comprise, or may be connected to a memory unit to store data, for example the input signal sample values, the signal difference values, the normalization value, a look-up table, etc., permanently or temporarily. Similarly, the second processor 4 may comprise, or may be connected to a memory unit to store data permanently or temporarily.

In operation, an analog audio input signal AS is input to the ADC, which converts the analog input signal AS into a digital audio input signal DS comprising a sequence of input signal sample values. The digital audio input signal DS is input to the first processor 2 which performs a coding operation on the digital audio input signal, e.g. according to steps 100 to 107 in FIG. 1. The first processor 2 outputs a processed digital audio input signal PDS. Next, the processed digital audio input signal PDS is transmitted (step 109 in FIG. 1) in an appropriate way by a transmitter TX, which may be part of the first processor 2, or may be a separate unit coupled to the first processor 2.

The processed digital signal PDS is received (step 111 in FIG. 1) by a receiver RX, which may be part of a second processor 4, or may be a separate unit coupled to the second processor 4. The received processed digital audio input signal PDS is input to the second processor 4, which performs a decoding operation, e.g. according to steps 113 to 115 of FIG. 1 or according to steps 113 to 115, 201 and 203 of FIG. 2, on the received processed digital audio input signal PDS, and outputs a decoded digital audio output signal DS2 which is highly similar to the digital audio input signal DS. The digital audio output signal DS2 is input to the DAC, which converts it into an analog output signal AS2, which is highly similar to the analog audio input signal AS.

Figure 4:
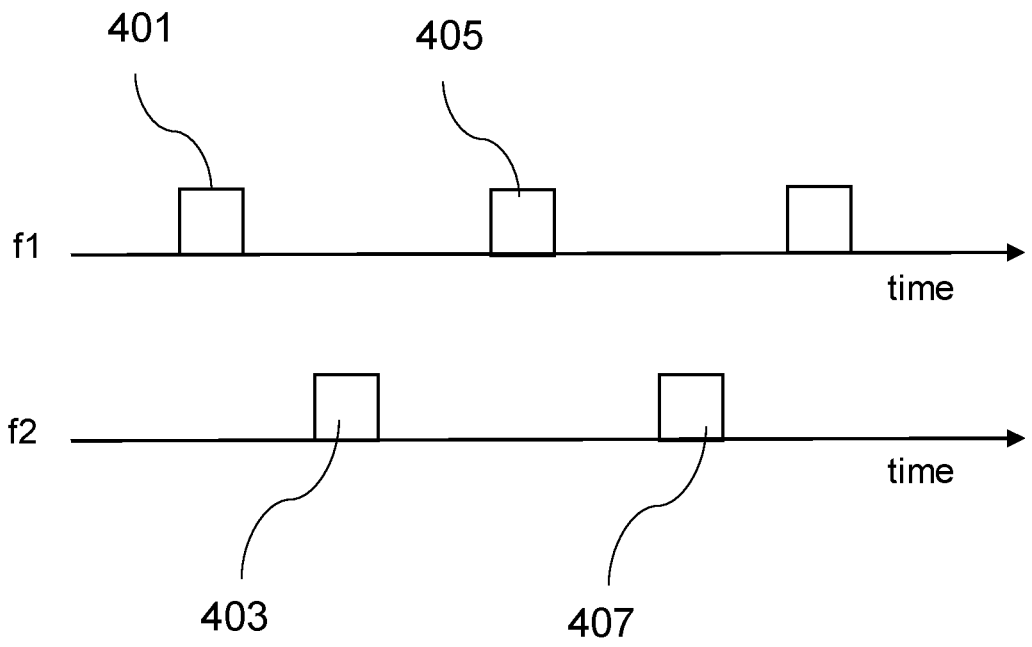
FIG. 4 illustrates transmissions at different frequencies.

FIG. 4 illustrates transmissions of various processed digital audio input signals PDS at different frequencies f1, f2. Here, f1 and f2 represent different frequencies on which data or data packets may be transmitted. Data packets 401, 403, 405, 407 each comprise reduced normalized signal difference values and a reduced normalization value. Since consecutive data packets are transmitted at different frequencies f1, f2 it may be possible to increase the robustness to interference of the transmission.

As explained in detail above, a method of and a system for processing a digital audio input signal containing a sequence of input signal sample values is disclosed. The method comprises:

determining signal difference values between consecutive pairs of input signal sample values in the sequence of input signal sample values, to obtain a group of signal difference values comprising consecutive signal difference values;

determining a normalization value for the group of signal difference values;

dividing each signal difference value in the group of signal difference values by a divider associated with the normalization value, to obtain a group of normalized signal difference values;

reducing a bit depth of the normalization value to obtain a reduced normalization value;

reducing a bit depth of each normalized signal difference value in the group of normalized signal difference values to obtain a group of reduced normalized signal difference values;

transmitting the group of reduced normalized signal difference values, and the reduced normalization value;

receiving the transmitted group of reduced normalized signal difference values, and the transmitted reduced normalization value;

multiplying each reduced normalized signal difference value by a multiplier associated with the reduced normalization value, to obtain a group of denormalized signal difference values; and determining a digital audio output signal containing a sequence of output signal sample values, wherein each output signal sample value is obtained by adding a corresponding denormalized signal difference value to an immediately preceding output signal sample value.

As required, detailed embodiments of the present invention are disclosed herein; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure. Further, the terms and phrases used herein are not intended to be limiting, but rather, to provide an understandable description of the invention.

The terms "a" or "an", as used herein, are defined as one or more than one. The term plurality, as used herein, is defined as two or more than two. The term another, as used herein, is defined as at least a second or more. The terms including and/or having, as used herein, are defined as comprising (i.e., open language, not excluding other elements or steps). Any reference signs in the claims should not be construed as limiting the scope of the claims or the invention.

The mere fact that certain measures are recited in mutually different dependent claims does not indicate that a combination of these measures cannot be used to advantage.

The term coupled, as used herein, is defined as connected, although not necessarily directly, and not necessarily mechanically.

The invention claimed is:

1. A method of processing a digital audio input signal containing a sequence of input signal sample values, the method comprising:

determining signal difference values between consecutive pairs of input signal sample values in the sequence of input signal sample values, to obtain a group of signal difference values comprising consecutive signal difference values;

determining a normalization value for the group of signal difference values;

dividing each signal difference value in the group of signal difference values by a divider associated with the normalization value, to obtain a group of normalized signal difference values;

reducing a bit depth of the normalization value to obtain a reduced normalization value;

reducing a bit depth of each normalized signal difference value in the group of normalized signal difference values to obtain a group of reduced normalized signal difference values;

transmitting the group of reduced normalized signal difference values, and the reduced normalization value;

receiving the transmitted group of reduced normalized signal difference values, and the transmitted reduced normalization value;

multiplying each reduced normalized signal difference value by a multiplier associated with the reduced normalization value, to obtain a group of denormalized signal difference values; and determining a digital audio output signal containing a sequence of output signal sample values, wherein each output signal sample value is obtained by adding a corresponding denormalized signal difference value to an immediately preceding output signal sample value.

2. The method according to claim 1, wherein the step of determining the digital audio output signal further comprises the steps of:

determining a group of correction values, wherein the group of correction values comprises the same number of values as the number of values in the group of denormalized signal difference values, and wherein each correction value is obtained by adding a denormalized signal difference value to a corresponding previous correction value; and subtracting each correction value from a corresponding output signal sample value.

3. The method according to claim 2, wherein each correction value has a higher bit depth than the bit depth of a denormalized signal difference value.

4. The method according to claim 1, wherein determining a normalization value comprises:

determining a largest signal difference value in the group of signal difference values; and determining the normalization value based on the largest signal difference value.

5. The method according to claim 4, wherein the step of determining the normalization value based on the largest signal difference value comprises:

setting the normalization value equal to the largest signal difference value.

6. The method according to claim 4, wherein the step of determining the normalization value based on the largest signal difference value comprises:

setting the normalization value equal to the position of the first nonzero bit closest to the most significant bit of the largest signal difference value.

7. The method according to claim 4, wherein the step of determining the normalization value based on the largest signal difference value comprises:

setting the normalization value equal to a value obtained after performing a first mathematical operation on the largest signal difference value.

8. The method according to claim 4, wherein the step of determining the normalization value based on the largest signal difference value comprises:

setting the normalization value equal to a position in a first lookup table associated with the largest signal difference value.

9. The method according to claim 8, wherein:

the divider is set equal to a first lookup value in the first lookup table, wherein a position of the first lookup value in the first lookup table is associated with the normalization value; and the multiplier is set equal to a second lookup value in a second lookup table, wherein a position of the second lookup value in the second lookup table is associated with the reduced normalization value.

10. The method according to claim 4, wherein the step of determining the normalization value based on the largest signal difference value comprises:

selecting a digital precision expressed as a number of bits;

determining a factor being at most equal to the largest number expressible in said number of bits;

dividing the largest signal difference value by the factor to obtain a quotient;

setting the normalization value to a value obtained after performing a second mathematical operation on the quotient.

11. The method according to claim 1, wherein:

the divider is set equal to the normalization value; and the multiplier is set equal to the reduced normalization value.

12. The method according to claim 1, wherein:

the divider is obtained by performing a third mathematical operation on the normalization value; and the multiplier is obtained by performing a fourth mathematical operation on the reduced normalization value.

13. The method according to claim 1, wherein dividing each signal difference value comprises performing a first arithmetic shift of each signal difference value, moving every bit of the respective signal difference value a number of positions, wherein the number is associated with the normalization value, in the direction of the least significant bit of the respective signal difference value, and wherein multiplying each reduced normalized signal difference value comprises performing a second arithmetic shift of each reduced normalized signal difference value, moving every bit of the respective reduced normalized signal difference value a number of positions, wherein the number is associated with the reduced normalization value, in the direction of the most significant bit of the respective reduced normalized signal difference value.

14. The method according to claim 1, wherein reducing a bit depth comprises truncating a number of bits.

15. The method according to claim 1, wherein at least some of the groups of reduced normalized signal difference values and the corresponding reduced normalization values are transmitted at different frequencies.

16. The method according to claim 1, wherein the sequence of input signal sample values contains a part of a sequence of input signal values of a previously processed digital audio input signal.

17. A system for processing a digital audio input signal containing a sequence of input signal sample values, the system comprising:

a first processor configured to determine signal difference values between consecutive pairs of input signal sample values in the sequence of input signal sample values, to obtain a group of signal difference values comprising consecutive signal difference values;

determine a normalization value for the group of signal difference values;

divide each signal difference value in the group of signal difference values by a divider associated with the normalization value, to obtain a group of normalized signal difference values;

reduce a bit depth of the normalization value to obtain a reduced normalization value; and reduce a bit depth of each normalized signal difference value in the group of normalized signal difference values to obtain a group of reduced normalized signal difference values;

a transmitter coupled to the first processor, the transmitter being configured to transmit the group of reduced normalized signal difference values, and the reduced normalization value;

a receiver configured to receive the transmitted group of reduced normalized signal difference values, and the transmitted reduced normalization value; and a second processor coupled to the receiver, the second processor being configured to multiply each reduced normalized signal difference value by a multiplier associated with the reduced normalization value, to obtain a group of denormalized signal difference values; and determine a digital audio output signal containing a sequence of output signal sample values, wherein each output signal sample value is obtained by adding a corresponding denormalized signal difference value to an immediately preceding output signal sample value.

18. A first non-transitory computer readable medium storing a computer program causing a computer to execute a coding method of coding a digital audio input signal containing a sequence of input signal sample values, the coding method comprising:

determining signal difference values between consecutive pairs of input signal sample values in the sequence of input signal sample values, to obtain a group of signal difference values comprising consecutive signal difference values;

determining a normalization value for the group of signal difference values;

dividing each signal difference value in the group of signal difference values by a divider associated with the normalization value, to obtain a group of normalized signal difference values;

reducing a bit depth of the normalization value to obtain a reduced normalization value;

reducing a bit depth of each normalized signal difference value in the group of normalized signal difference values to obtain a group of reduced normalized signal difference values; and initiating a transmitting of the group of reduced normalized signal difference values, and the reduced normalization value; and a second non-transitory computer readable medium storing a computer program causing a computer to execute a decoding method of decoding a digital audio input signal containing a sequence of input signal sample values coded according to the coding method, the decoding method comprising:

initiating a receiving of the transmitted group of reduced normalized signal difference values, and the transmitted reduced normalization value;

multiplying each reduced normalized signal difference value by a multiplier associated with the reduced normalization value, to obtain a group of denormalized signal difference values; and determining a digital audio output signal containing a sequence of output signal sample values, wherein each output signal sample value is obtained by adding a corresponding denormalized signal difference value to an immediately preceding output signal sample value.

* * * * *